US009140120B2

(12) United States Patent
Niederriter et al.

(10) Patent No.: US 9,140,120 B2
(45) Date of Patent: Sep. 22, 2015

(54) LUMP BREAKER FOR MINING MACHINE

(71) Applicant: Joy MM Delaware, Inc., Wilmington, DE (US)

(72) Inventors: Edward F. Niederriter, Fryburg, PA (US); Shawn W. Franklin, Emlenton, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 0 days.

(21) Appl. No.: 14/033,430

(22) Filed: Sep. 20, 2013

(65) Prior Publication Data

US 2014/0084666 A1 Mar. 27, 2014

Related U.S. Application Data

(60) Provisional application No. 61/703,990, filed on Sep. 21, 2012.

(51) Int. Cl.

| | |
|---|---|
| ***E21C 27/08*** | (2006.01) |
| ***E21C 35/00*** | (2006.01) |
| ***E21C 27/02*** | (2006.01) |
| ***E21C 29/02*** | (2006.01) |
| ***E21F 13/00*** | (2006.01) |

(52) U.S. Cl.

CPC ..... *E21C 35/00* (2013.01); *E21C 27/02* (2013.01); *E21C 27/08* (2013.01); *E21C 29/02* (2013.01); *E21F 13/002* (2013.01)

(58) Field of Classification Search

CPC ..... E21C 27/08
USPC ..... 299/34.02, 95
See application file for complete search history.

(56) References Cited

U.S. PATENT DOCUMENTS

| | | | | | |
|---|---|---|---|---|---|
| 2,084,139 | A | * | 6/1937 | Hamm et al. | 241/200 |
| 3,784,256 | A | | 1/1974 | Katlic | |
| 3,907,367 | A | * | 9/1975 | Nakajima | 299/53 |
| 3,945,680 | A | | 3/1976 | Henrich et al. | |
| 4,123,110 | A | * | 10/1978 | Parrott et al. | 299/43 |
| 4,172,561 | A | * | 10/1979 | Parrott | 241/185.5 |

(Continued)

FOREIGN PATENT DOCUMENTS

| | | |
|---|---|---|
| PL | 157321 | 5/1992 |
| PL | 165551 | 1/1995 |

(Continued)

OTHER PUBLICATIONS

Search Report from the Patent Office of the Republic of Poland for Polish Application No. P.405401 dated Jan. 16, 2014 (2 pages, English translation).

*Primary Examiner* — John Kreck
(74) *Attorney, Agent, or Firm* — Michael Best & Friedrich LLP

(57) ABSTRACT

A longwall shearer is positioned adjacent a face conveyor for transporting material that is cut from a mining face. The longwall shearer includes a chassis, an arm pivotably coupled to the chassis, a cutting drum for engaging the mining face, and a lump breaker for engaging material on the face conveyor. The chassis includes a first end and a second end, and the chassis is movable in at least a first direction that is generally parallel to the mining face. The cutting drum is rotatably supported on the arm. The lump breaker is pivotably coupled to the chassis about an axis, and the lump breaker includes at least one tooth for breaking apart the cut material.

15 Claims, 4 Drawing Sheets

(56) References Cited

U.S. PATENT DOCUMENTS

| | | | | |
|---|---|---|---|---|
| 4,180,291 | A * | 12/1979 | Lobbe et al. | 299/34.02 |
| 4,465,319 | A | 8/1984 | Brownlie | |
| 4,668,016 | A | 5/1987 | Hart | |
| 4,887,867 | A | 12/1989 | Porteous et al. | |
| 5,997,101 | A | 12/1999 | Peterson | |
| 7,013,937 | B2 | 3/2006 | Potts | |
| 2011/0254346 | A1 | 10/2011 | Neilson et al. | |
| 2012/0007413 | A1 | 1/2012 | Zimmerman | |
| 2012/0073445 | A1 | 3/2012 | Plush | |

FOREIGN PATENT DOCUMENTS

| | | |
|---|---|---|
| PL | 173182 | 2/1998 |
| PL | 173225 | 2/1998 |

* cited by examiner

LUMP BREAKER FOR MINING MACHINE

CROSS-REFERENCE TO RELATED APPLICATION

This application claims the benefit of and priority to U.S. Provisional Patent Application No. 61/703,990, filed Sep. 21, 2012, the entire contents of which are hereby incorporated by reference herein.

BACKGROUND

The present invention relates to underground mining machines, and in particular to a lump crusher for a longwall shearer.

Longwall shearer mining machines are commonly used in underground mining applications. Conventional longwall shearers generally include a chassis and a pair of arms pivotably coupled to the chassis. Each of the arms supports a rotatable cutting drum that is equipped with teeth and removes material from a mining face. The longwall shearer is coupled to an armored face conveyor for movement in a lateral direction substantially parallel to the mining face. In operation, large pieces of removed material fall from the mining face onto the armored face conveyor, which carries the material away from the mining face. If not broken up, crushed, or split into fragments, the large pieces of removed material may become stuck between an underside of the chassis of the longwall shearer and the armored face conveyor, thereby clogging the passage of the removed material and potentially causing production delays.

SUMMARY

In one embodiment, the invention provides a longwall shearer for cutting material from a mining face. The longwall shearer is positioned adjacent a face conveyor for transporting material. The longwall shearer includes a chassis, an arm pivotably coupled to the chassis, a cutting drum for engaging the mining face, and a lump breaker for engaging material on the face conveyor. The chassis includes a first end and a second end, and the chassis is movable in at least a first direction that is generally parallel to the mining face. The cutting drum is rotatably supported on the arm. The lump breaker is pivotably coupled to the chassis about an axis, and the lump breaker includes at least one tooth for breaking apart the cut material.

In another embodiment, the invention provides a lump breaker for a longwall shearer, the longwall shearer having a chassis supporting a cutting drum for cutting material from a mining face. The chassis is positioned proximate a face conveyor for transporting cut material in a first direction. The lump breaker includes an elongated arm, a plurality of teeth for engaging material transported on the face conveyor, and an actuator. The arm includes a first end and a second end. The first end is adapted to be pivotably coupled to the chassis proximate the face conveyor and the first end is pivotable about an axis. The teeth are supported on the arm. The actuator pivots the arm about the axis and includes a first end coupled to the arm and a second end adapted to be coupled to the chassis.

In yet another embodiment, the invention provides a longwall mining system for cutting material from a mining face, the longwall mining system includes a face conveyor for transporting material in a first direction, a chassis coupled to the face conveyor and positioned above the face conveyor, an arm pivotably coupled to the chassis, and a lump breaker for engaging the material transported by the face conveyor. The face conveyor extends parallel to the mining face. The chassis includes a first end and a second end and is movable along the face conveyor in at least the first direction. The arm rotatably supports a cutting drum for engaging the mining face. The lump breaker is pivotably coupled to the chassis and includes at least one tooth positioned proximate the face conveyor.

Other aspects of the invention will become apparent by consideration of the detailed description and accompanying drawings.

It should be understood that the invention is not limited in its application to the details of construction and the arrangements of the components set forth in the following description or illustrated in the above-described drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Figure 1:
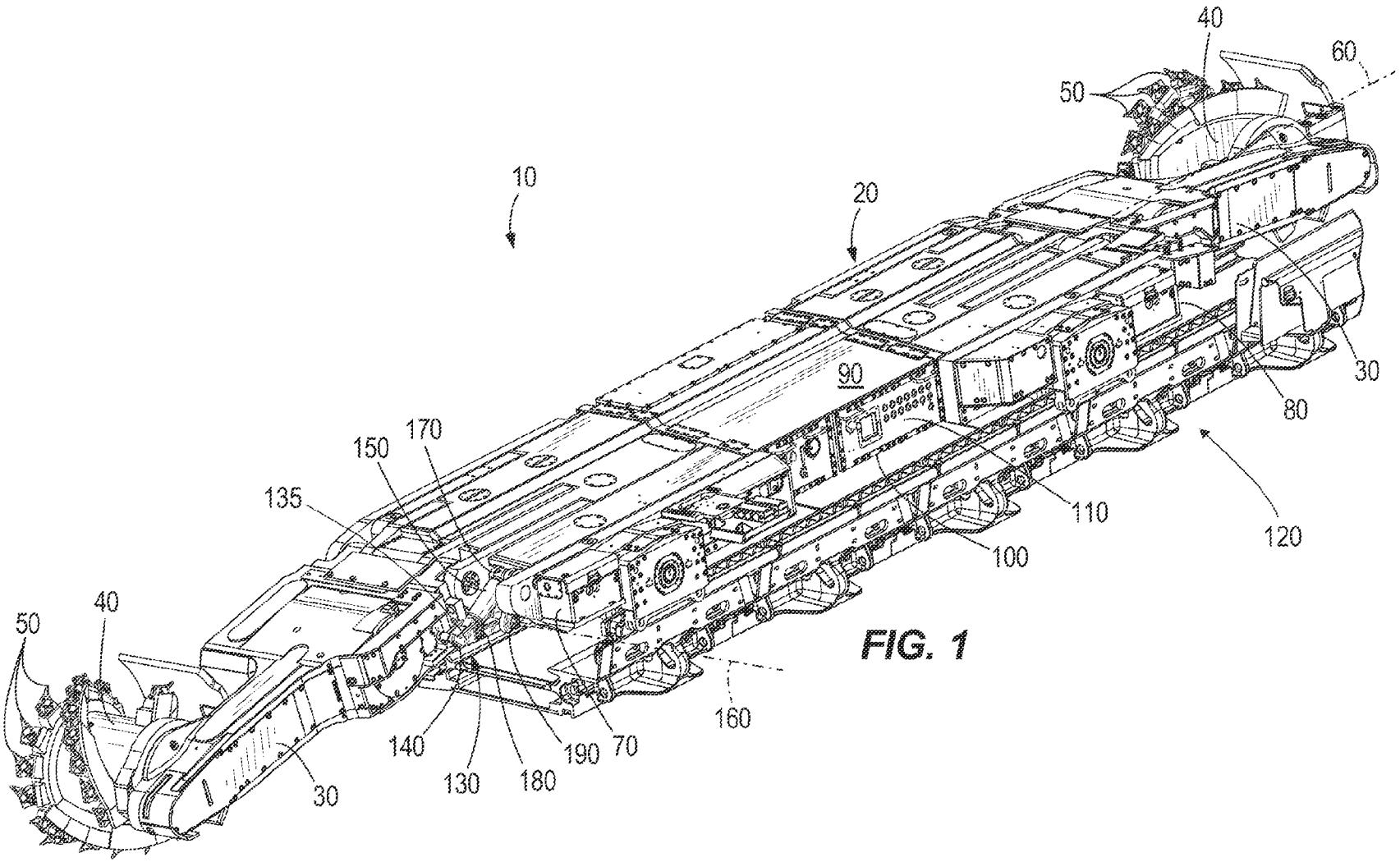
FIG. 1 is a perspective view of a longwall shearer and a face conveyor according to one embodiment.

FIG. 1 is a perspective view of a mining machine, such as a longwall shearer 10. The longwall shearer 10 includes a chassis 20 with a pair of movable arms 30, each arm 30 located at an opposite end of the chassis 20. Each arm 30 supports a rotatable cutting drum 40 including teeth 50 for removing material from a mining face (not shown). The chassis 20 is a generally rectangular box that measures longer along a longitudinal axis 60 generally extending between the cutting arms 30 (i.e., in a direction that is generally parallel to the mining face), and shorter in a direction that is perpendicular to the longitudinal axis 60. As such, the chassis 20 defines a left side wall 70 proximate one end of the chassis 20 and a second side wall 80 proximate an opposite end of the chassis 20. The side walls 70, 80 extend substantially parallel to each other, and four walls extend between the side walls 70, 80: a top wall 90, a bottom wall or underside 100, a front wall 110, and a rear wall (not shown; the rear wall is positioned substantially symmetrical to the front wall 110 about the longitudinal axis 60). As used herein, the terms "left," "right," "top," "bottom," "front," "rear," "side," and other directional terms are not intended to require a particular orientation, but are used instead for purposes of description only.

The chassis 20 of the longwall shearer 10 is generally positioned above an armored face conveyor 120, which is located adjacent the base of the mining face. The chassis 20 moves along the face conveyor 120 in a lateral direction substantially parallel to a mining face. In the illustrated embodiment, the longwall shearer 10 is coupled to the conveyor 120 (for example, by a rack-and-pinion connection) and advances in the lateral direction from left to right, i.e., with the right side wall 80 as a leading or head end of the chassis 20 and the left side wall 70 as a trailing or tail end of the chassis 20. The material removed from the mining face is collected on the face conveyor 120, which carries the material away from the mining area for further processing. In one embodiment, the armored face conveyor 120 carries the removed material from left to right, i.e., from the tail end 70 to the head end 80 of the chassis 20.

In operation, large pieces of removed material fall from the mining face onto the armored face conveyor 120. If not broken up or split into fragments, the large pieces of removed material may become stuck between the underside 100 of the chassis 20 of the longwall shearer 10 and the armored face conveyor 120, thereby clogging the passage of the removed material and potentially causing production delays. A conventional lump breaker may include a rotatably-driven breaker drum for engaging and breaking apart the lumps. Because the breaker drum must be large enough to provide sufficient rotational energy and inertia to break the lumps into smaller pieces, it is cumbersome to house or store a conventional lump breaker on the longwall shearer 10. As such, the conventional lump breaker is bulky and requires substantial space that is not available on the longwall shearer 10. For example, the longwall shearer 10 frequently moves in entryways with limited headroom or clearance, making it desirable for the longwall shearer to have a compact footprint; however, the size of the conventional lump breaker makes it difficult to house or store the rotatably-driven breaker drum on the chassis in a compact manner.

Figure 2:
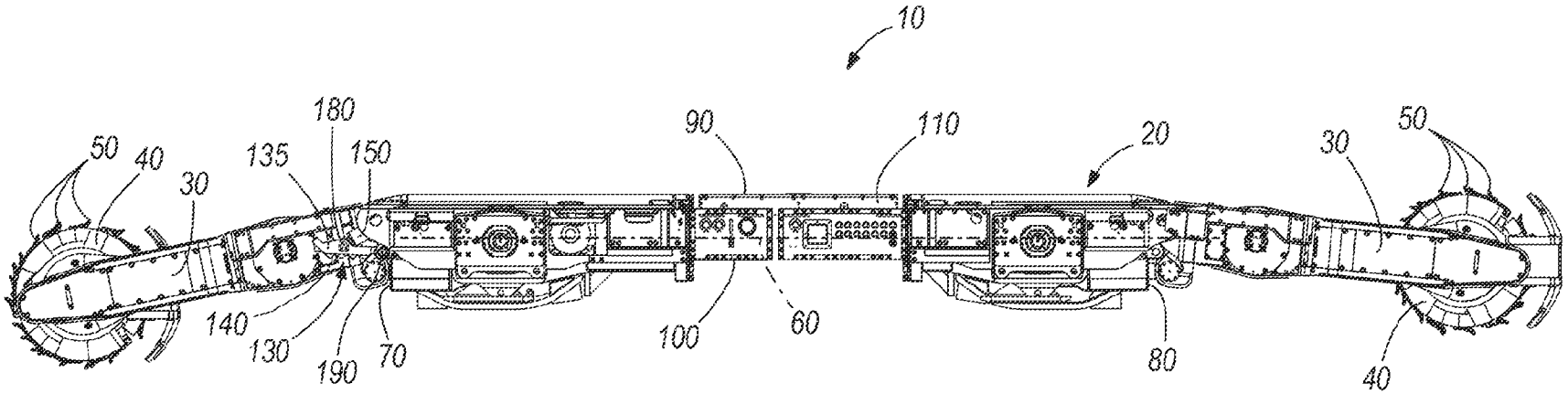
FIG. 2 is a side view of the longwall shearer of FIG. 1.
Figure 3:
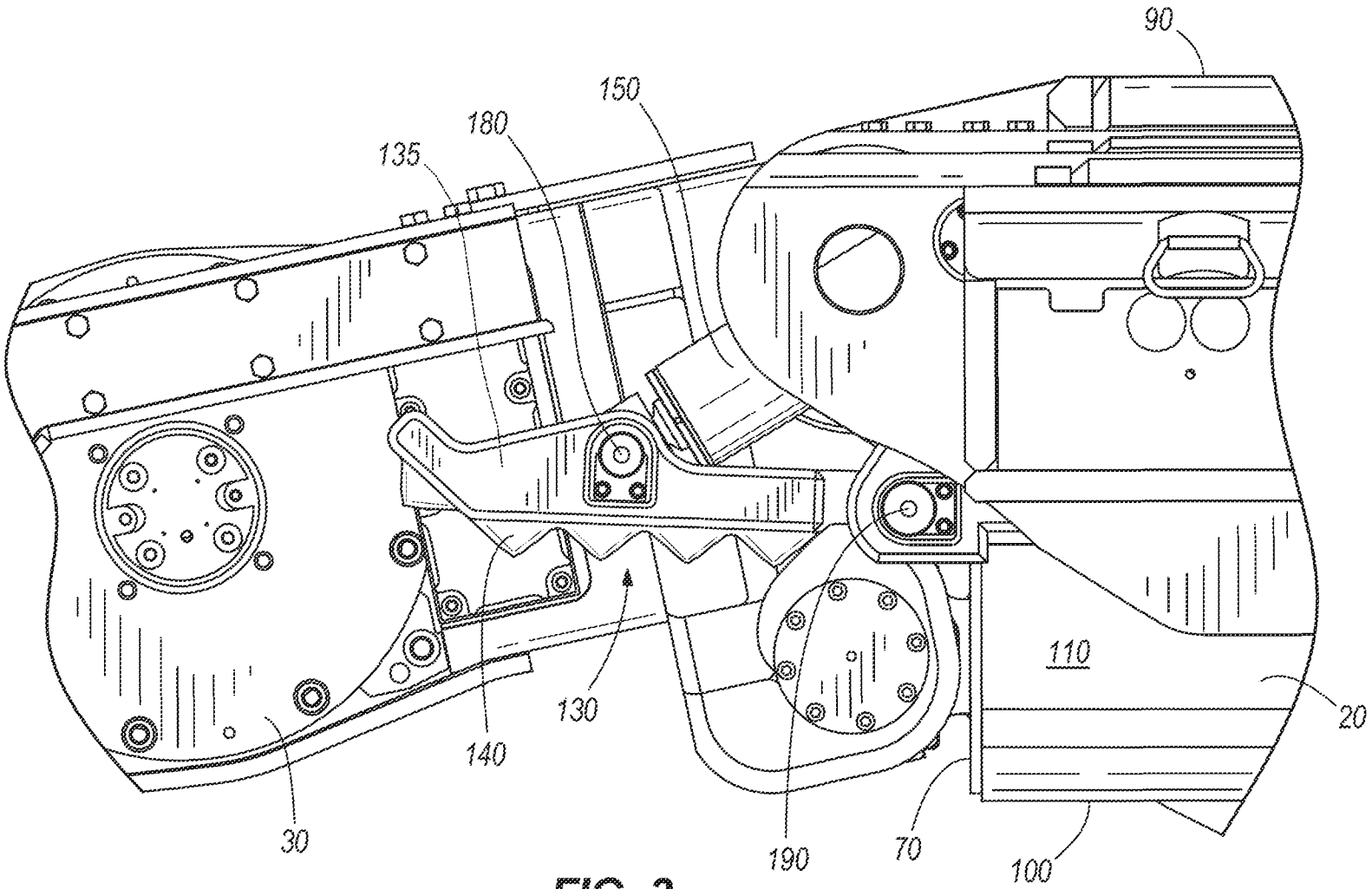
FIG. 3 is an enlarged side view of a portion of the longwall shearer of FIG. 1.
Figure 4:
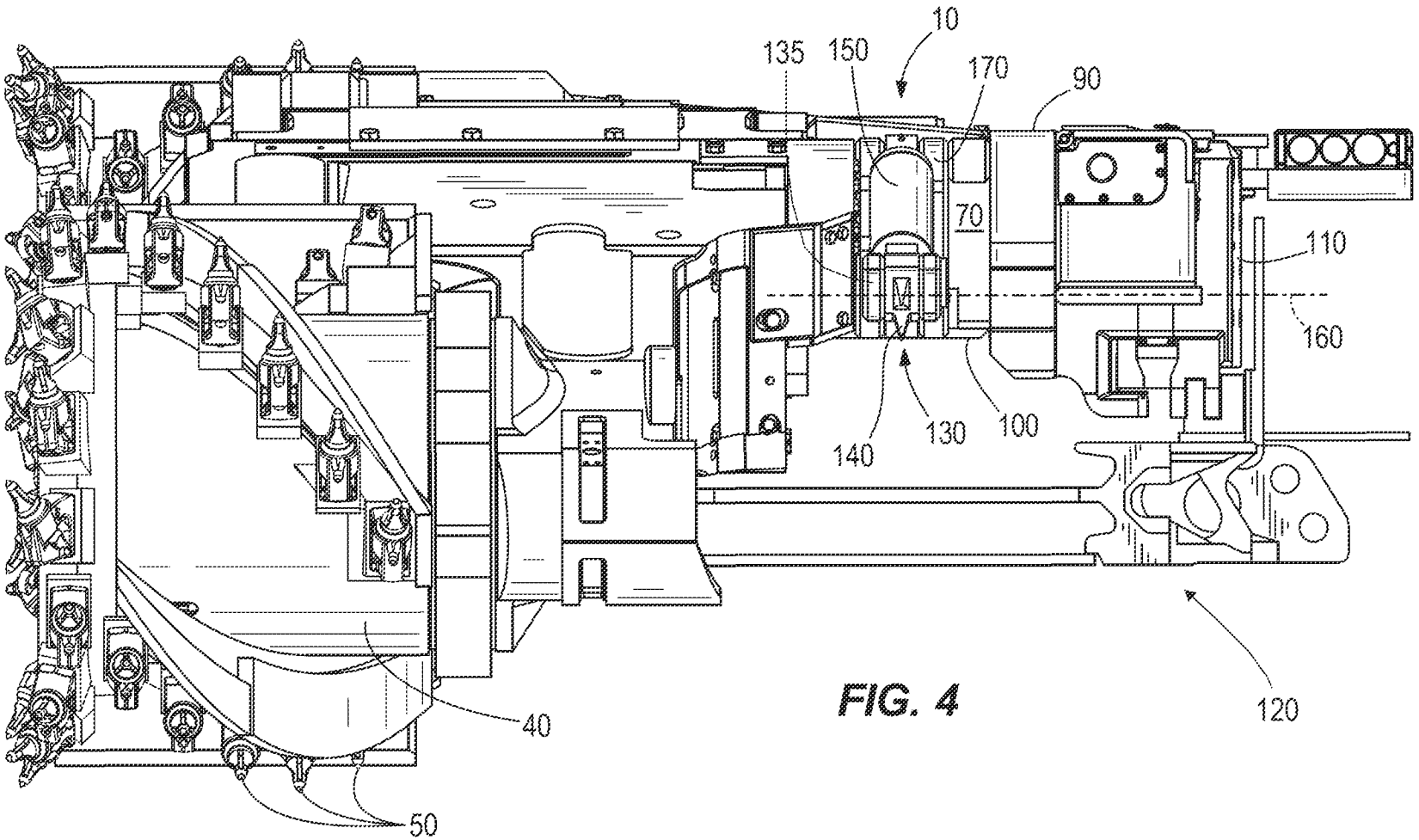
FIG. 4 is an end view of the longwall shearer and face conveyor of FIG. 1.

Referring to FIGS. 2-4, the longwall shearer 10 includes a lump crusher 130 to break, crush, or split the large pieces of removed material. The lump crusher 130 is hingedly or pivotably coupled to the chassis 20. The lump crusher 130 includes a breaker arm or member 135 supporting teeth 140, and the breaker member 135 is driven by an electric motor (not shown) through an actuator or coupling member 150. In the illustrated embodiment, the breaker member 135 is an elongated arm having an end that is pivotably coupled to the chassis 20, and an opposite end of the arm is angled with respect to the end that is coupled to the chassis 20. In other embodiments, the breaker member 135 may include one or more angled and/or arcuate portions.

In the illustrated embodiment, the teeth 140 are arranged substantially linearly along the length of the breaker member 135. In other embodiments, the teeth 140 are arranged in other patterns. Although the lump crusher 130 shown in FIG. 3 includes five teeth 140, other embodiments may utilize fewer or more teeth 140. Furthermore, each tooth 140 may assume any suitable geometric form, including, but not limited to, a pyramidal, a conical, a cylindrical, a regular polyhedral, and an irregular polyhedral shape, derivatives thereof, and combinations thereof. The teeth 140 may be made out of steel or other suitably wear-resistant materials. In some embodiments, one or more teeth 140 can be individually detached, separated, or dislodged from the breaker member 135 (e.g., in case the particular tooth becomes worn or damaged). In other embodiments, however, all teeth 140 are integrally formed with the breaker member 135. In further embodiments, the lump crusher 130 can be (in whole or in part) removed, released, or detached from the chassis 20 to facilitate replacing worn or damaged parts.

The coupling member 150 extends and retracts to lower and raise the breaker member 135 (and therefore the teeth 140) relative to the chassis 20, thereby breaking up, crushing, or splitting the large pieces of removed material on the conveyor 120 below the chassis 20. In contrast to prior art configurations, the lump crusher 130 does not include a cutting drum that is rotatably driven about the longitudinal axis 60 of the chassis 20 (FIG. 3). Instead, the lump crusher 130 is driven to pivot angularly about a pivot axis 160 (FIG. 4) that is substantially perpendicular to the longitudinal axis 60. The lump crusher 130 applies steady, static force on the material to cause the material to fracture. In this regard, the lump crusher 130 may resemble and operate like a nutcracker that includes a hinged hammer exerting a force on an item between the hammer and an anvil. The lump crusher 130 has a compact profile compared to prior art configurations that include a rotatably-driven cutting drum, and therefore can be suitably housed or stored on the longwall shearer 10 in a compact manner.

In the illustrated embodiment, the coupling member 150 is attached to the chassis 20 at a first attachment point 170 (FIG. 1) proximate a first end or side wall 70. The coupling member 150 is also attached to the breaker member 135 at a second attachment point 180, while the breaker member 135 is attached to the chassis 20 at a third attachment point 190. The first, second, and third attachment points 170, 180, 190 roughly form a triangle when viewed in a direction perpendicular to the longitudinal axis 60 of the chassis 20. Particularly, when the coupling member 150 is in the retracted configuration, the coupling member 150 roughly forms the hypotenuse of a right triangle, with the left side wall 70 of the chassis 20 and the teeth 140 forming the other two sides of the triangle. By varying the length of the coupling member 150, the position of the teeth 140 are varied. For example, extending the length between the first and second attachment points 170, 180 results in angularly lowering the teeth 140 about the pivot axis 160 toward the armored face conveyor 120. On the other hand, shortening the length between the first and second attachment points 170, 180 results in angularly raising the breaker arm 135 about the pivot axis 160 away from the armored face conveyor 120.

Although in the illustrated embodiment the teeth 140 are hingedly attached to the chassis 20 at the third attachment point 190, in other embodiments, the teeth 140 may be attached only to the coupling member 150 and not the chassis 20. Instead of being driven angularly about the pivot axis 160, the teeth 140 may thus be driven linearly, e.g., raised and lowered in directions substantially perpendicular to the longitudinal axis 60 of the chassis 20. Moreover, although in the illustrated embodiment the coupling member 150 is attached to the left side wall 70 of the chassis 20, in other embodiments, the coupling member 150 may be attached to other parts of the chassis 20, e.g., the opposite end or right side wall 80 of the chassis 20. Furthermore, although FIGS. 1 and 4 illustrate a single coupling member 150, other embodiments may use more than one coupling member 150. Although FIGS. 1 and 2 illustrate a single lump crusher 130, other embodiments may use more lump crushers 130 (e.g., one on each end of the chassis 20).

The coupling member 150 may extend and retract by means of mechanical, hydraulic, pneumatic, or electric systems depending upon the capabilities and configuration of the coupling member 150. In some embodiments, the coupling member 150 may be controlled manually, e.g., using wired or wireless signals that relay a signal for the coupling member 150 to extend and retract. The manual control may be positioned onboard the longwall shearer 10 or remote from the actual mining components. In some embodiments, the coupling member 150 is automatically extendable and retractable when the longwall shearer 10 travels along the mining face. For example, the longwall shearer 10 may include various sensors, transducers, cameras, and the like that provide a signal or information such as the degree of clogging on an underside 100 of the chassis 20. The coupling member 150 may be operable to extend and retract in response to information received from the sensors.

Thus, the invention provides, among other things, a lump crusher for a longwall shearer mining machine. Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A longwall shearer for cutting material from a mining face, the longwall shearer positioned adjacent a face conveyor for transporting material, the longwall shearer comprising:

a chassis including a first end and a second end, the chassis movable in at least a first direction that is generally parallel to the mining face;

an arm pivotably coupled to the chassis;

a cutting drum for engaging the mining face, the cutting drum rotatably supported on the arm and rotatable about a drum axis; and a lump breaker for engaging material on the face conveyor, the lump breaker including a breaker arm having a first end and a second end, the first end pivotably coupled to the chassis about an arm axis parallel to the drum axis, the breaker arm further including a planar surface extending between the first end and the second end, the breaker arm further including a plurality of teeth for breaking apart the cut material, the teeth supported on the planar surface and aligned linearly in a plane perpendicular to the arm axis.

2. The longwall shearer of claim 1, wherein the lump breaker further includes an actuator coupled between the chassis and the breaker arm and operation of the actuator pivots the breaker arm about the arm axis.

3. The longwall shearer of claim 1, wherein the planar surface defines a first portion proximate the first end and a second portion proximate the second end, the second portion being oriented at an angle relative to the first portion.

4. The longwall shearer of claim 1, wherein the arm axis is generally perpendicular to the first direction.

5. A lump breaker for a longwall shearer, the longwall shearer including a chassis supporting a cutting drum for cutting material from a mining face, the chassis positioned proximate a face conveyor for transporting cut material in a first direction, the lump breaker comprising:

an elongated arm including a first end and a second end, the first end adapted to be pivotably coupled to the chassis proximate the face conveyor, the first end being pivotable about an axis perpendicular to the first direction and parallel to a pan of the face conveyor, the arm including a planar surface extending between the first end and the second end;

a plurality of teeth for engaging material transported on the face conveyor, the teeth supported on the planar surface and aligned linearly within a plane perpendicular to a pan of the face conveyor and parallel to the first direction; and an actuator for pivoting the arm about the axis, the actuator including a first end coupled to the arm and a second end adapted to be coupled to the chassis.

6. The lump breaker of claim 5, wherein the planar surface defines a first portion proximate the first end and a second portion proximate the second end, the second portion being oriented at an angle relative to the first portion.

7. The lump breaker of claim 5, wherein the axis is generally perpendicular to the first direction of travel of the cut material.

8. The lump breaker of claim 5, wherein the planar surface of the arm is substantially perpendicular to the axis.

9. A longwall mining system for cutting material from a mining face, the longwall mining system comprising:

a face conveyor defining a conveyor surface for transporting material, the face conveyor extending in a first direction;

a chassis coupled to the face conveyor and positioned above the face conveyor, the chassis including a first end and a second end, the chassis being movable along the face conveyor in at least the first direction;

an arm pivotably coupled to the chassis, the arm supporting a cutting drum for rotation about a drum axis; and a lump breaker for engaging material transported by the face conveyor, the lump breaker including a breaker arm having a first end and a second end, the first end pivotably coupled to the chassis about a breaker arm axis parallel to the drum axis, the breaker arm including a plurality of teeth positioned proximate the face conveyor, the teeth aligned in a plane perpendicular to the breaker arm axis and perpendicular to the conveyor surface.

10. The longwall mining system of claim 9, wherein the lump breaker further includes an actuator coupled between the chassis and the breaker arm such that operation of the actuator pivots the breaker arm about the breaker arm axis.

11. The longwall mining system of claim 9, wherein the breaker arm defines a first portion proximate the first end and a second portion proximate the second end, the second portion being oriented at an angle relative to the first portion.

12. The longwall mining system of claim 9, wherein the breaker arm axis is generally perpendicular to the first direction.

13. The longwall mining system of claim 9, wherein the teeth are aligned along a surface that is substantially perpendicular to the breaker arm axis.

14. The longwall mining system of claim 9, wherein the plane in which the teeth are aligned is generally parallel to the first direction.

15. The longwall shearer of claim 3, wherein the breaker arm moves toward the conveyor when the breaker arm pivots in a second direction, wherein the second portion of the planar surface is angled relative to the first portion in a third direction opposite the second direction.

* * * * *